US010576351B2

(12) United States Patent
Ramaswamy

(10) Patent No.: US 10,576,351 B2
(45) Date of Patent: Mar. 3, 2020

(54) COMPETITION MAT PROTECTION DEVICE

(71) Applicant: Isaac Ramaswamy, Patchogue, NY (US)

(72) Inventor: Isaac Ramaswamy, Patchogue, NY (US)

( * ) Notice: Subject to any disclaimer, the term of this patent is extended or adjusted under 35 U.S.C. 154(b) by 24 days.

(21) Appl. No.: 15/953,797

(22) Filed: Apr. 16, 2018

(65) Prior Publication Data

US 2019/0126121 A1 May 2, 2019

Related U.S. Application Data

(60) Provisional application No. 62/580,352, filed on Nov. 1, 2017.

(51) Int. Cl.
*A63B 71/00* (2006.01)
*A63B 6/00* (2006.01)

(52) U.S. Cl.
CPC ..... *A63B 71/0036* (2013.01); *A63B 6/00* (2013.01)

(58) Field of Classification Search
CPC .... A45F 4/00; A47G 9/06; A63B 6/00; A63B 71/00; A63B 71/0036; A63B 71/0038
USPC ..... 206/225, 315.1, 389–415
See application file for complete search history.

(56) References Cited

U.S. PATENT DOCUMENTS 6,751,816 B1 * 6/2004 Wechsler ..... A47G 9/062 5/417
7,007,322 B2 * 3/2006 Alane ..... A47G 27/0237 5/417
7,086,533 B1 * 8/2006 Enko ..... A63F 9/1044 206/315.1
9,028,383 B2 * 5/2015 Carrasca ..... A63B 6/00 482/142
2015/0305537 A1 * 10/2015 Zich ..... A47G 27/0212 206/389

FOREIGN PATENT DOCUMENTS

CA 2936211 C * 1/2018

* cited by examiner

*Primary Examiner* — Bryon P Gehman
(74) *Attorney, Agent, or Firm* — Carter, DeLuca & Farrell LLP

(57) ABSTRACT

A competition mat protection device includes an elongate body that has a length and a width that correspond to the length and width of a competition mat. The elongate body has a bottom surface that is positioned on a top surface of the competition mat when the competition mat is in a deployed configuration. When the competition mat is rolled up to a stowed configuration, the elongate body of the mat protection device is positioned between the top surface and a bottom surface of the competition mat to prevent the transfer of dirt and bacteria from the bottom surface onto the top surface of the competition mat. The elongate body has a length to extend around the competition mat in the stowed configuration to protect an outer surface of the mat.

21 Claims, 4 Drawing Sheets

COMPETITION MAT PROTECTION DEVICE

CROSS-REFERENCE TO RELATED APPLICATIONS

The present application claims the benefit of and priority to U.S. Provisional Patent Application Ser. No. 62/580,352 filed on Nov. 1, 2017, the entire contents of which are incorporated herein by reference.

BACKGROUND

1. Technical Description

The present disclosure is directed to mat protection devices and, more particularly to a mat protection device for protecting a competition mat during periods of non-use.

2. Background of Related Art

Competition mats are used during a variety of sporting events including wrestling, martial arts, and cheerleading to provide a padded surface to reduce impact of a fall to an athlete during a sporting event. Typically, the competition mat is rolled out onto a gymnasium floor or other support surface from a stowed configuration to a deployed configuration to provide a padded surface for athletes to compete during the sporting event. In the deployed configuration, a bottom surface of the competition mat rests on top of the support surface while the top surface of the competition mat is positioned to support the sporting event. After the sporting event has ended, the competition mat is rolled up from the deployed configuration to the stowed configuration and moved to a storage location, i.e., to one side of the gymnasium floor, to allow other sporting events, e.g., basketball, to be played on the support surface.

When a competition mat is rolled up from the deployed configuration to the stowed configuration, a bottom surface of the mat that was in contact with the support surface comes into direct contact with the top surface of the mat. When this occurs, dirt and bacteria from the bottom surface of the mat may be transferred to the top surface of the mat causing damage to the top surface of the mat and/or subjecting the athlete to a variety of skin conditions including tinea (ringworm), impetigo, herpes, and methicillin resistant staphylococcus aureus (MRSA). In addition, in the stowed configuration, it may be difficult to transport the mat to the storage location without dragging and damaging the mat along the support surface.

A continuing need exists in the art for a mat protector that is configured to minimize the transfer of dirt and bacteria from the bottom surface of the mat to the top surface of the mat during stowage of the mat and also for a device to facilitate transport of the mat in the stowed configuration to a storage location.

SUMMARY

One aspect of the disclosure is directed to a mat protection device including an elongate body, a carry handle assembly, at least one grab handle, and at least one retaining strap. The elongate body defines a longitudinal axis and is formed of a pliable material. The elongate body has a first end portion, a second end portion, an upper surface, and a lower surface, a length, and a width. The carry handle assembly is supported on the upper surface of the first end portion of the elongate body and includes a carry handle strap having a first end supporting a first handle and a second end supporting a second handle. The carry handle strap has a length to position the first and second handles on opposite sides of the elongate body. The at least one grab handle is secured to the bottom surface of the elongate body. The at least one retaining strap extends from the second end portion of the elongate body and has a length to allow the at least one retaining strap to be wrapped about a competition mat when the competition mat and the elongate body are rolled up together to a stowed configuration.

In embodiments, the at least one grab handle includes first and second grab handles that are spaced from each other along the width of the elongate body.

In some embodiments, the at least one grab handle is formed from a grab handle strap that is stitched across the width of the elongate body, wherein the at least one grab handle is defined by a portion of the grab handle strap that is not stitched to the elongate body.

In certain embodiments, the at least one retaining strap includes first and second retaining straps that are spaced from each other along the width of the elongate body.

In embodiments, each of the first and second retaining straps includes hook and loop fasteners to secure the first and second retaining straps about the competition mat when the competition mat is in the stowed configuration.

In some embodiments, the carry handle strap is secured to the first end portion of the elongate body.

In certain embodiments, the carry handle strap is secured to the first end portion of the elongate body by hook and loop fasteners.

In embodiments, the mat protection device includes first and second side covers, wherein each the first and second side covers is dimensioned to receive one of the sides of the competition mat when the competition mat is in the stowed configuration.

In some embodiments, each of the side covers includes a closed end cap and an annular body secured to the closed end cap, wherein the annular body is dimensioned to receive the sides of the competition mat when the competition mat is in the stowed configuration.

In certain embodiments, each of the closed end caps defines a slot that is dimensioned to facilitate passage of a respective one of the first and second handles of the carry handle assembly.

In embodiments, the annular body of each of the end caps includes an elastic band.

In some embodiments, the first end portion of the elongate body includes pockets that are positioned to receive corners of the competition mat.

In certain embodiments, the elongate body is formed of vinyl.

In embodiments, the mat protection device includes clips that are configured to secure the first end portion of the elongate body to a first end portion of the competition mat.

Another aspect of the present disclosure is directed to a method of protecting a competition mat when the competition mat is in a stowed position including positioning a bottom surface of an elongate body of a mat protection device on a top surface of the competition mat with a bottom surface of the competition mat positioned on a support surface and the competition mat in a deployed configuration; rolling the competition mat about itself from the deployed configuration to a stowed configuration with the elongate body of the mat protection device positioned on the top surface of the competition mat such that the elongate body of the mat protection device is positioned between the top and bottom surfaces of the competition mat when the competition mat is in the stowed configuration; and wrapping the second end portion of the elongate body about the competition mat after the competition mat is in the stowed position to cover an exposed surface of the competition mat.

In embodiments, the method also includes positioning a carry handle assembly on an upper surface of the first end portion of the elongate body prior to rolling the competition mat from the deployed configuration to the stowed configuration such that first and second handles of the carry handle assembly extend from opposite sides of the competition mat when the competition mat is in the stowed configuration.

In some embodiments, the method also includes positioning side covers over the opposite sides of the competition mat when the competition mat is in the stowed configuration.

In certain embodiments, the method also includes pulling first and second handles of the carry handle assembly through respective slots formed in the side covers.

In embodiments, the method includes wrapping retaining straps that extend from a second end portion of the elongate body about the elongate body after the second end portion of the elongate body is wrapped about the competition mat to secure the elongate body about the competition mat.

In some embodiments, the method includes grasping grab handles supported on the bottom surface of the second end portion of the elongate body after the competition mat is in the stowed configuration to lift and move the competition mat.

In certain embodiments, the method includes grasping the first and second handles of the carry handle assembly after the competition mat is in the stowed configuration to lift and transport the competition mat to a storage location.

BRIEF DESCRIPTION OF THE DRAWINGS

Various exemplary embodiments of the presently disclosed mat protection device are described herein below with reference to the drawings, wherein.

DETAILED DESCRIPTION OF EMBODIMENTS

Figure 1:
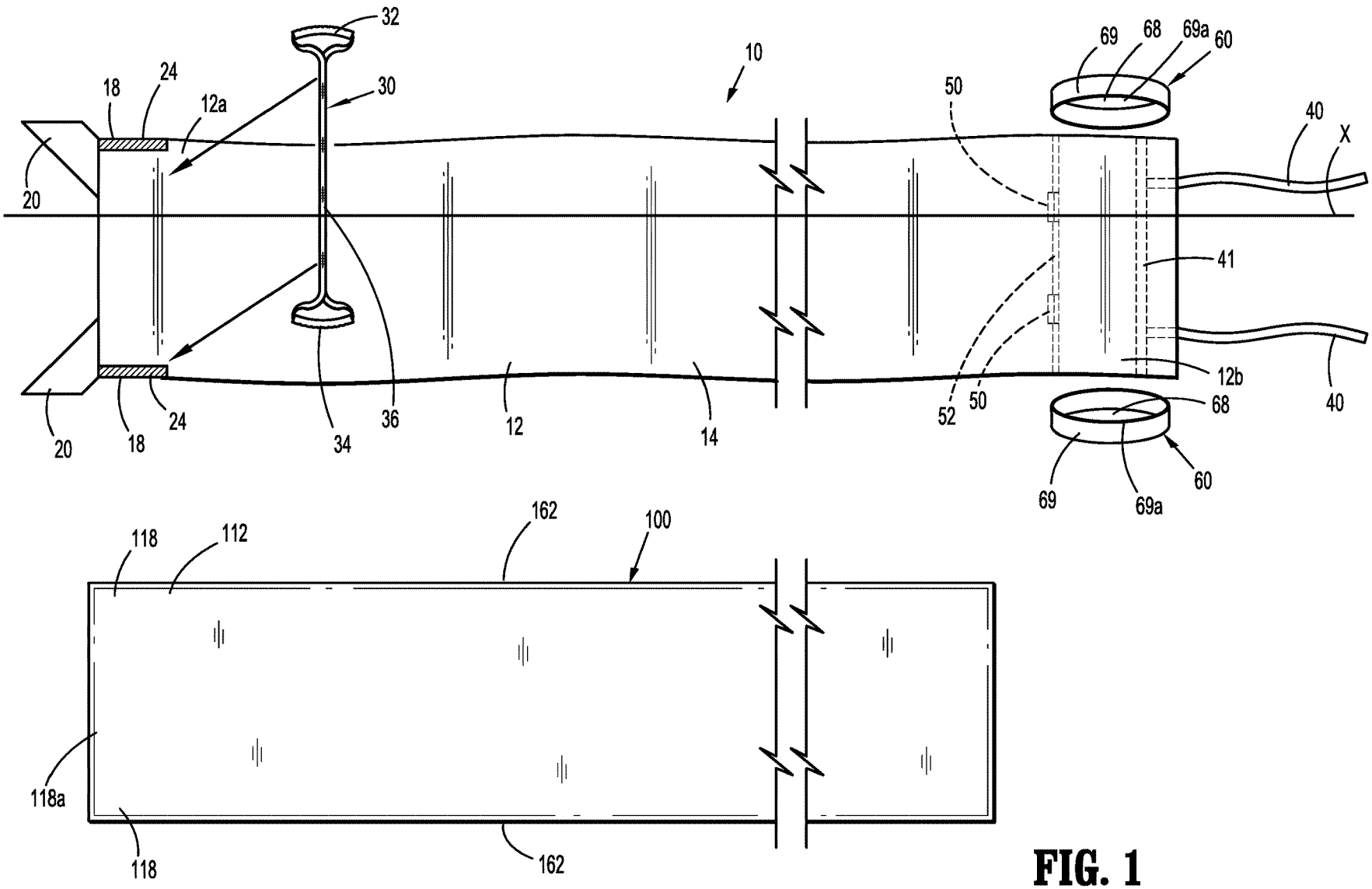
FIG. 1 is a top, exploded view of an exemplary embodiment of the presently disclosed mat protection device in association with a competition mat with the mat protection device and the competition mat in a deployed configuration.

The presently disclosed mat protection device will now be described in detail with reference to the drawings in which like reference numerals designate identical or corresponding elements in each of the several views. However, it is to be understood that the disclosed embodiments are merely exemplary of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

Figure 2:
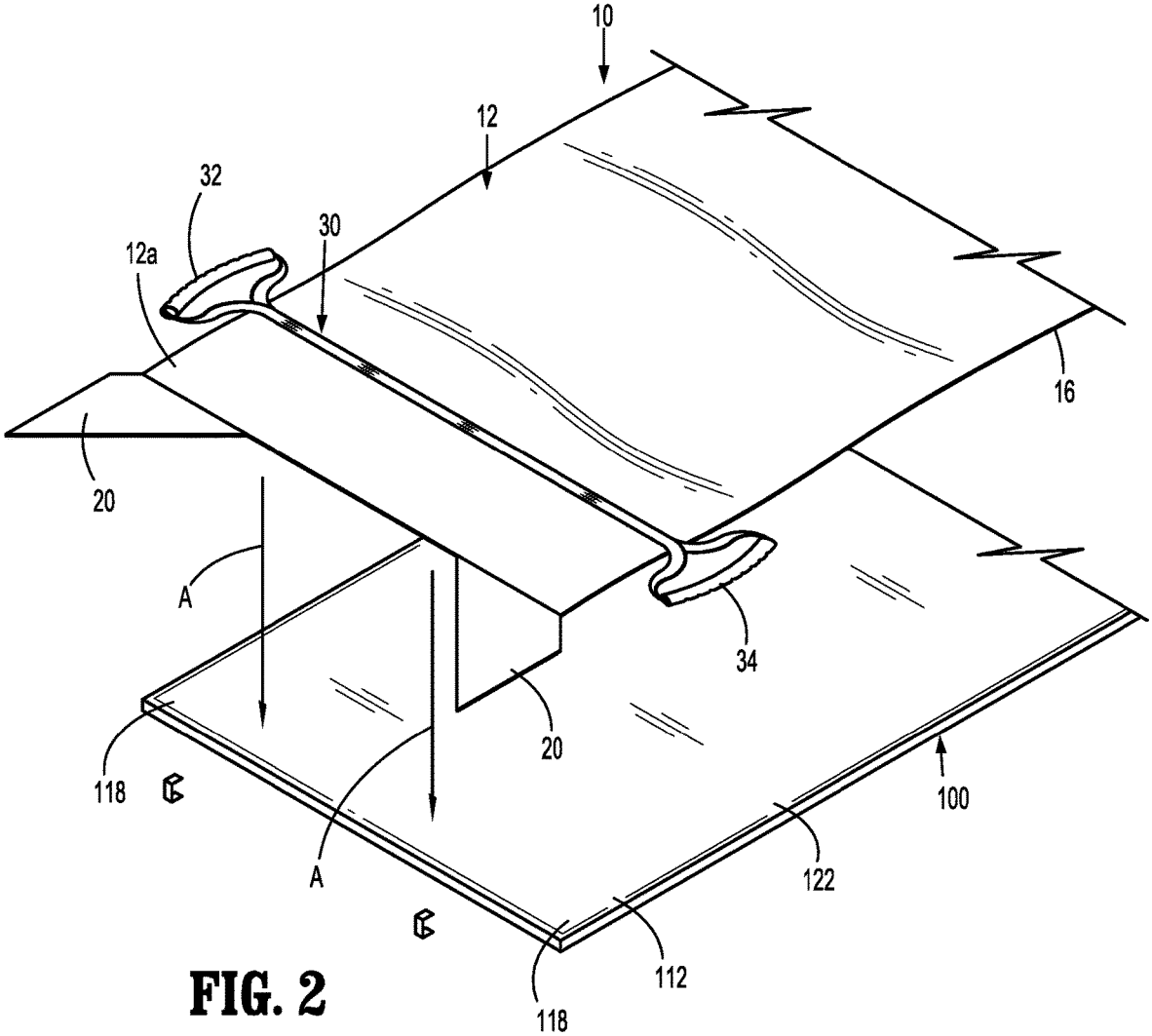
FIG. 2 is a perspective cutaway view of a first end of the mat protection device and competition mat shown in FIG. 1 in the deployed configuration with the mat protection device positioned above a top surface of the completion mat.

Referring to FIG. 1, the presently disclosed competition mat protection device is shown generally as mat protection device 10. The mat protection device 10 includes an elongate body 12 having an upper surface 14 and a lower surface 16 (FIG. 2). The elongate body 12 defines a longitudinal axis "X" and has a shape that corresponds to the shape of a competition mat 100 and typically has a length that is substantially greater than its width. For example, in embodiments, the elongate body 12 may be configured to protect a wrestling mat and may have a length of about 52 feet and a width of about 6 feet. Alternately, other configurations are envisioned. In embodiments, the elongate body 12 is formed of a pliable material such as vinyl although the use of other materials or combinations of materials is envisioned.

Figure 4:
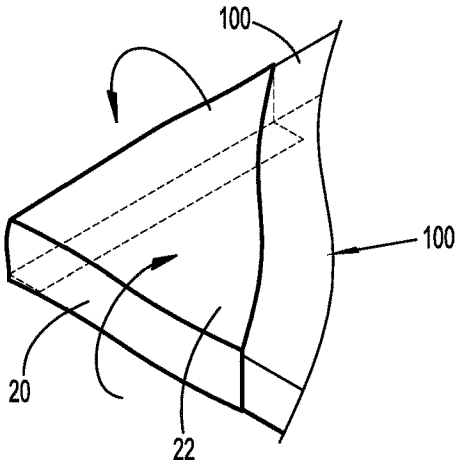
FIG. 4 is an enlarged view of a corner of the bottom side of the first end of the mat protection device and competition mat shown in FIG. 1 with a pocket flap of the mat protector in a secured position defining a pocket and the corner of the competition mat positioned within the pocket of the mat protector.

The elongate body 12 of the mat protection device 10 has a first end portion 12*a* and a second end portion 12*b*. In embodiments, the first end portion 12*a* has spaced corners 18 that support flaps 20. The flaps 20 can be folded about the corners 18 of the elongate body 12 to form pockets 22 (FIG. 4) on the lower surface 16 of the elongate body 12. The pockets 22 receive corners 118 on a first end portion 118*a* of the of the competition mat 100 to secure the first end portion 12*a* of the elongate body 12 to the first end portion 118*a* of the competition mat 100. In embodiments, the upper surface 14 of the elongate body 12 includes hook and loop fasteners 24, e.g., Velcro™, that engage hook and loop fasteners (not shown) on the flaps 20 to secure the flaps 20 in a pocket configuration. Alternately, the flaps 20 can be fixedly secured to the spaced corners 18 of the elongate body 12 to define fixed pockets 22 as shown in FIG. 4.

Figure 3:
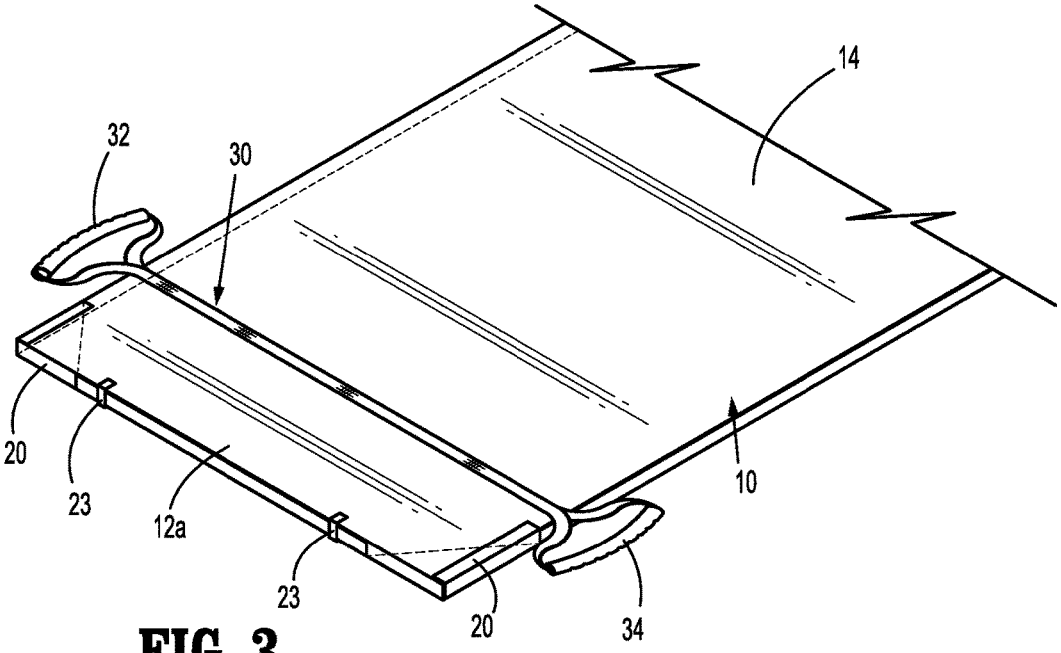
FIG. 3 is a perspective cutaway view of the first end of the mat protection device and competition mat shown in FIG. 1 in the deployed configuration with the mat protection device positioned atop the top surface of the competition mat.

It is envisioned that the mat protection device 10 need not include pockets but, in the alternative may include clips 23 (FIG. 1) for securing the first end portion 12*a* of the elongate body 12 to the first end portion 118*a* of the competition mat 100. Alternatively, the pockets 22 and the clips 23 can be used in unison as shown in FIG. 3.

The mat protection device 10 includes a carry handle assembly 30 positioned on the upper surface 14 of the elongate body 12. In embodiments, the carry handle assembly 30 is secured to the elongate body 12 near the end of the first end portion 12*a*, e.g., about one foot from the end of the first end portion 12*a*. The carry handle assembly 30 includes a first handle 32, a second handle 34, and a strap 36 that interconnects the first handle 32 to the second handle 34. The length of the strap 36 allows the first and second handles 32, 34 to extend from opposite sides of the competition mat 100 when the competition mat 100 is rolled up to the stowed configuration. In some embodiments, the length of the strap 36 is substantially the same as or greater than the width of the elongate body 12 and the width of the competition mat 100.

Figure 5:
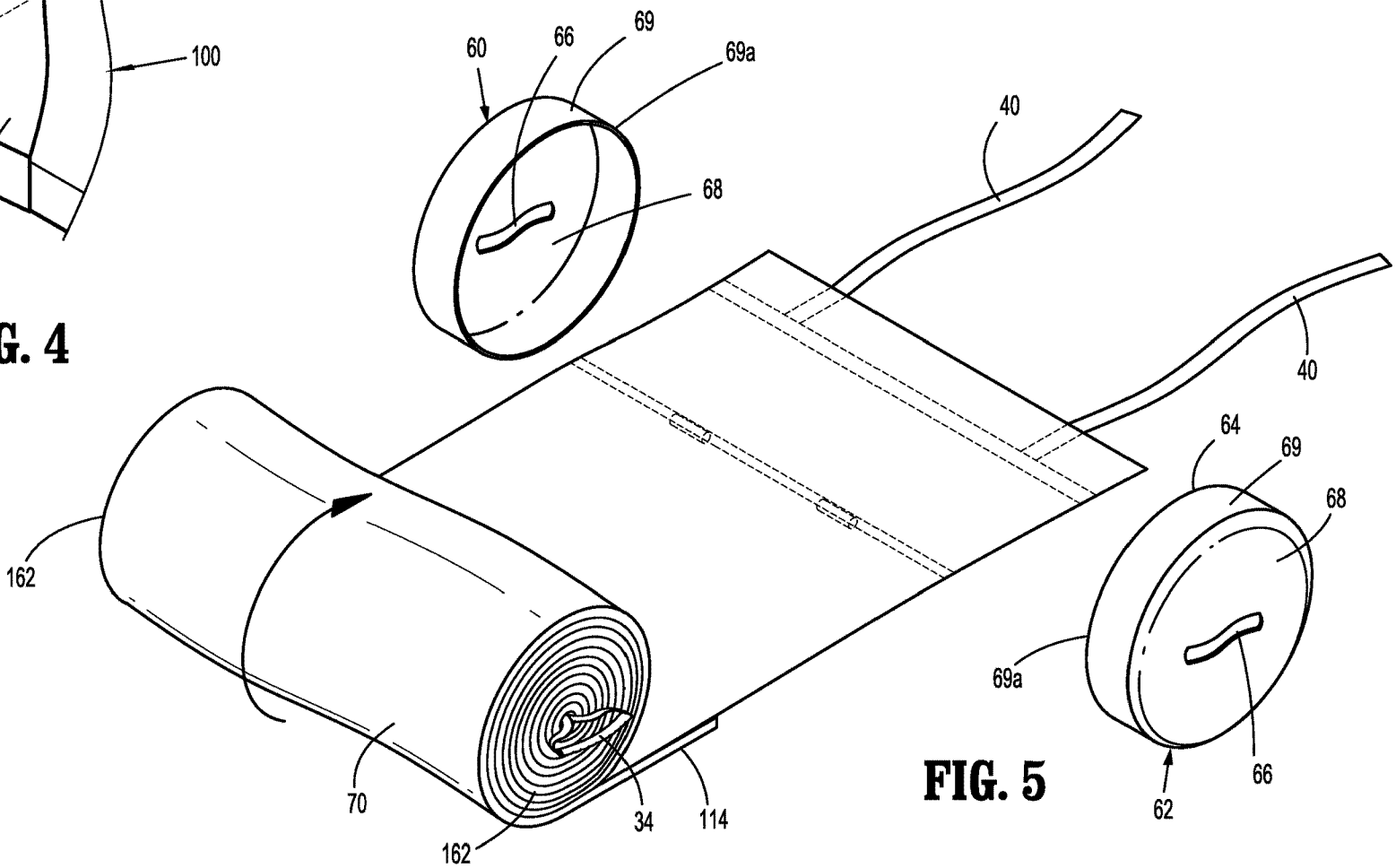
FIG. 5 is a side perspective view of the mat protection device and competition mat shown in FIG. 1 as the competition mat and mat protector are rolled to the stowed configuration.

Each of the first and second handles 32, 34 of the carry handle assembly 30 may include an ergonomic grip that may be formed of a compressible material to allow the stowed competition mat 100 to be lifted and transported as described below. The carry handle assembly 30 can be a separate component from the elongate body 12 that is positioned on the first end portion 12*a* of the elongate body 12 prior to rolling up the elongate body 12 to the stowed configuration (FIG. 5). It is also envisioned that the carry handle assembly 30 can be fixedly secured to the upper surface 14 of the first end portion 12*a* of the elongate body 12 using, e.g., stitching, or releasably secured to the first end portion 12*a* of the elongate body 12 using, e.g., hook and loop fasteners, to prevent removal or displacement of the carry handle assembly 30 in relation to the elongate body 12 during stowage.

Figure 6:
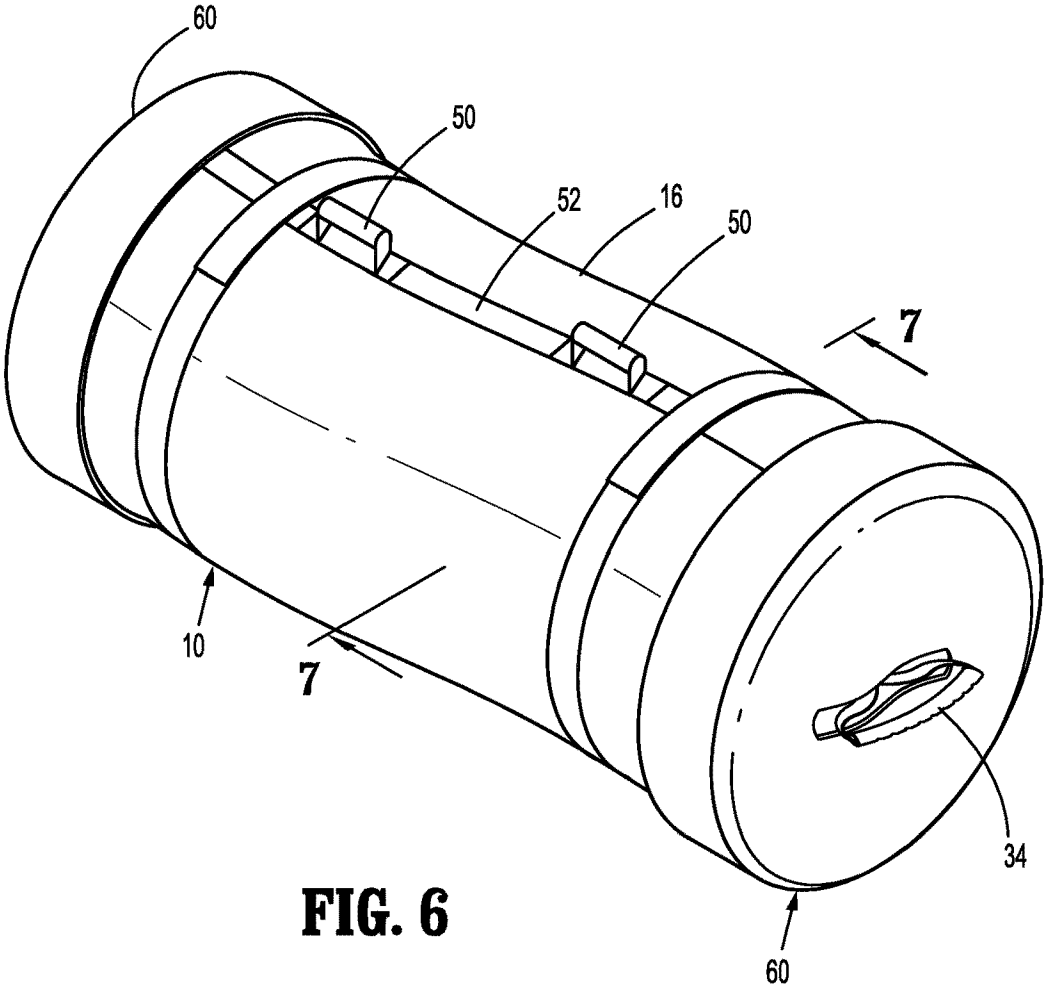
FIG. 6 is a side perspective view of the mat protection device and competition mat shown in FIG. 1 with the mat protection device and competition mat in the stowed configuration and side covers of the mat protection device secured about ends of the mat.

The elongate body 12 includes a pair of retaining straps 40 that are secured to the lower surface 16 of the second end portion 12*b*. In embodiments, the retaining straps 40 are secured to the second end 12*b* of the elongate body 12 by stitching 42 and extend in a direction substantially parallel to the longitudinal axis "X" of the elongate body 12. Alternately, the retaining straps 40 can be secured to the elongate body 12 using any known fastening technique. The retaining straps 40 are of a length to extend around the mat 100 and the elongate body 12 when the mat 100 is in the stowed configuration (FIG. 6) to secure the mat 100 in the stowed configuration. In some embodiments, the retaining straps 40 are about 10 feet in length and include about 1 foot of strap that is secured or stitched to the elongate body 12. A transverse strap 41 that extends across the width of the elongate body 12 and is stitched to the elongate body 12 may be provided to add strength to the joint between the retaining straps 40 and the elongate body 12. Each of the retaining straps 40 may include hook and loop fasteners, a buckle, or the like (not shown) to secure the retaining straps 40 about the mat 100 in the stowed configuration (FIG. 6).

The lower surface 16 of the second end portion 12*b* of the elongate body 12 includes outer grab handles 50 that are supported on a grab handle strap 52. In embodiments, each of the outer grab handles 50 is secured to the second end portion 12*b* of the elongate body about 2 feet from one of the opposite sides of the elongate body 12. The grab handles 50 can be secured to the second end portion 12*b* of the elongate body 12 by stitching although other fastening techniques such as the use of adhesives are envisioned. In embodiments, the grab handles 50 can form part of the strap 52 that is stitched to the second end portion 12*b* of the elongate body 12. More particularly, a portion of each of the straps 52 that is not stitched to the elongate body 12 can define one of the grab handles 50. Alternately, other handle configurations and types are envisioned.

The mat protection device 10 also includes first and second side covers 60. The side covers 60 are configured to cover opposite sides 162 of the mat 100 when the mat 100 is rolled up to the stowed configuration (FIG. 6). The side covers 60 may be attached to the elongate body 12 by stitching or the like. Alternately, the side covers 60 can be separate from the elongate body 12. In embodiments, each of the side covers 60 includes a closed end cap 68 and an annular body 69 secured to the closed end cap 68. The annular body 69 has a diameter that is dimensioned to receive one of the sides 162 of the mat 100 when the mat 100 is in the stowed configuration (FIG. 6). In embodiments, the annular body 69 may include a resilient or elastic band 69*a* that expands when the side cover 60 is placed about one of the opposite sides 162 of the mat 100. Each of the closed end caps 68 of the side covers 60 defines a slit or cutout 66 that receives one of the first and second handles 32, 34 (FIG. 6) when the mat 100 is in the stowed configuration such that the first and second handles 32, 34 are accessible to facilitate transport of the stowed mat 100.

Referring to FIGS. 2-4, in order to move the competition mat 100 from the deployed configuration (FIG. 1) to the stowed configuration (FIG. 6), the elongate body 12 of the mat protection device 10 is positioned on top of the competition mat 100 in the direction indicated by arrows "A" in FIG. 2 with the lower surface 16 of the elongate body 12 in opposed relation to a top surface 122 of the mat 100. If the carry handle assembly 30 is not already secured to the first end portion 12*a* of the elongate body 12, the carry handle assembly 30 is positioned on the first end portion 12*a* of the elongate body 12. With the elongate body 12 positioned on top of the mat 100, the flaps 20 are folded about the corners 118 of the elongate body 12 to form the pockets 22 (FIG. 4) to secure and align the first end portion 12*a* of the elongate body 12 with the mat 100. As discussed above, the flaps 20 can be fixedly secured to the elongate body 12 in a pocket configuration with hook and loop fasteners, e.g., Velcro™. Alternately, if the pockets 22 are fixed on the ends of the elongate body 12, the corners 118 of the mat 100 can be slid into the pockets 22 to secure the first end portion 12*a* of the elongate body 12 to the corners 118 of the mat 100.

Figure 7:
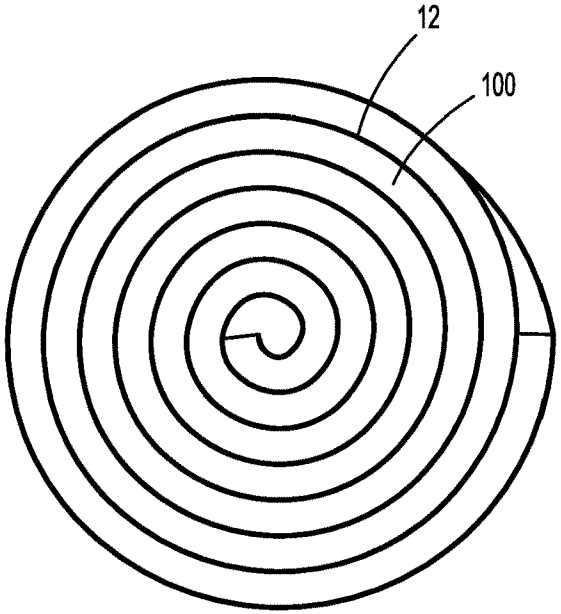
FIG. 7 is a cross-sectional view taken along section line 7-7 of FIG. 6.

Referring to FIGS. 5-7, after the corners 118 of the mat 100 are positioned within the pockets 22 of the elongate body 12, the mat 100 can be rolled up towards the stowed configuration (FIG. 6). As the mat 100 is rolled up towards the stowed position, the elongate body 12 of the mat protection device 10 is positioned between the top and bottom surfaces of the mat 100 to provide a barrier there between (FIG. 7) to minimize the likelihood of debris and bacteria being transferred to the top surface 122 of the mat 100. As the mat 100 is rolled up, the carry handle assembly 30 is positioned within the center of the roll with a handle 32, 34 of the carry handle assembly 30 extending from each of the opposite sides 162 of the roll 70. When the mat 100 has been rolled up, the elongate body should have a sufficient length remaining to allow the elongate body 12 to be wrapped about the exposed portion of the bottom surface 114 of the mat 100. After the elongate body 12 of the mat protection device 10 is wrapped about the rolled up mat 100, the retaining straps 40 can be wrapped about the stowed mat 100 and mat protection device to retain the mat 100 and mat protection device 10 in the stowed configuration. As discussed above, the retaining straps 40 may include hook and loop fasteners, a buckle or the like to secure the retaining straps 40 about the mat 100.

After the retaining straps 40 are wrapped about the mat 100 to retain the mat 100 in the stowed configuration, the side covers 60 can be placed onto the opposite sides 162 (FIG. 5) of the mat 100 and the carry handles 32, 34 can be pulled through the slots 66 in the side covers 60. The handles 32, 34 allow the mat 100 in its stowed configuration to be lifted and transported to a storage location without dragging the mat 100 along the support surface. In the stowed configuration, the grab handles 50 also facilitate manipulation of the mat 100.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A mat protection device comprising:

an elongate body defining a longitudinal axis and being formed of a pliable material, the elongate body having opposite sides, a first end portion, a second end portion, an upper surface, and a lower surface, the elongate body having a length defined between the first and second end portions and a width defined between the opposite sides;

a carry handle assembly supported on the upper surface of the first end portion of the elongate body, the carry handle assembly including a carry handle strap having a first end supporting a first handle and a second end supporting a second handle, the carry handle strap extending across the width of the elongate body to position the first and second handles on the opposite sides of the elongate body;

at least one grab handle secured to the lower surface of the elongate body on the second end portion of the elongate body between the opposite sides; and at least one retaining strap extending from the second end portion of the elongate body, the at least one retaining strap having a length to allow the at least one retaining strap to be wrapped about a competition mat when the competition mat and the elongate body are rolled up together to a stowed configuration.

2. The mat protection device of claim 1, wherein the at least one grab handle includes first and second grab handles that are spaced from each other along the width of the elongate body.

3. The mat protection device of claim 1, wherein the at least one grab handle is formed from a grab strap that is stitched across the width of the elongate body, wherein the at least one grab handle is defined by a portion of the grab handle strap that is not stitched to the elongate body.

4. The mat protection device of claim 1, wherein the at least one retaining strap includes first and second retaining straps, the first and second retaining straps being spaced along the width of the elongate body.

5. The mat protection device of claim 4, wherein each of the first and second retaining straps includes hook and loop fasteners to secure the first and second retaining straps about the competition mat when the competition mat is in the stowed configuration.

6. The mat protection device of claim 1, wherein the carry handle strap is secured to the first end portion of the elongate body.

7. The mat protection device of claim 6, wherein the carry handle strap is secured to the first end portion of the elongate body by hook and loop fasteners.

8. The mat protection device of claim 1, further including first and second side covers, each the first and second side covers being dimensioned to receive one of the sides of the competition mat when the competition mat is in the stowed configuration.

9. The mat protection device of claim 8, wherein each of the side covers includes a closed end cap and an annular body secured to the closed end cap, wherein the annular body is dimensioned to receive the sides of the competition mat when the competition mat is in the stowed configuration.

10. The mat protection device of claim 9, wherein each of the closed end caps defines a slot that is dimensioned to facilitate passage of a respective one of the first and second handles of the carry handle assembly.

11. The mat protection device of claim 9, wherein the annular body of each of the end caps includes an elastic band.

12. The mat protection device of claim 1, wherein the first end portion of the elongate body includes pockets that are positioned to receive corners of the competition mat.

13. The mat protection device of claim 1, wherein the elongate body is formed of vinyl.

14. The mat protection device of claim 1, wherein the mat protection device includes clips that are configured to secure the first end portion of the elongate body to the a first end portion of the competition mat.

15. A method of protecting a competition mat when the competition mat is in a stowed configuration comprising:

positioning a bottom surface of an elongate body of a mat protection device having a first end portion and a second end portion on a top surface of the competition mat with a bottom surface of the competition mat positioned on a support surface and the competition mat in a deployed configuration;

rolling the competition mat about itself from the deployed configuration to a stowed configuration with the elongate body of the mat protection device positioned on the top surface of the competition mat such that the elongate body of the mat protection device is positioned between the top and bottom surfaces of the competition mat when the competition mat is in the stowed configuration; and wrapping the second end portion of the elongate body about the competition mat after the competition mat is in the stowed configuration to cover and protect an exterior an exposed surface of the competition mat.

16. The method of claim 15, further including positioning a carry handle assembly on an upper surface of the first end portion of the elongate body prior to rolling the competition mat from the deployed configuration to the stowed configuration such that first and second handles of the carry handle assembly extend from opposite sides of the competition mat when the competition mat is in the stowed configuration.

17. The method of claim 16, further including positioning side covers over the opposite sides of the competition mat when the competition mat is in the stowed configuration.

18. The method of claim 17, further including pulling first and second handles of the carry handle assembly through respective slots formed in the side covers.

19. The method of claim 15, further including wrapping retaining straps that extend from a second end portion of the elongate body about the elongate body after the second end portion of the elongate body is wrapped about the competition mat to secure the elongate body about the competition mat.

20. The method of claim 15, further including grasping grab handles supported on the bottom surface of the second end portion of the elongate body after the competition mat is in the stowed configuration to lift and move the competition mat.

21. The method of claim 15, further including grasping the first and second handles of the carry handle assembly after the competition mat is in the stowed configuration to lift and transport the competition mat to a storage location.

* * * * *